US006631722B2

(12) United States Patent
MacAdam et al.

(10) Patent No.: US 6,631,722 B2
(45) Date of Patent: Oct. 14, 2003

(54) TOBACCO SMOKE FILTER ELEMENTS

(75) Inventors: Kevin Gerard MacAdam, Southampton (GB); Rosemary Elizabeth O'Reilly, Southamptom (GB); Nigel David Warren, Southampton (GB)

(73) Assignee: British-American Tobacco Company Limited (GB)

( * ) Notice: Subject to any disclaimer, the term of this patent is extended or adjusted under 35 U.S.C. 154(b) by 0 days.

(21) Appl. No.: 08/315,138

(22) Filed: Sep. 22, 1994

(65) Prior Publication Data

US 2003/0098033 A1 May 29, 2003

(30) Foreign Application Priority Data

Sep. 30, 1993 (GB) ..... 9320130
Sep. 30, 1993 (GB) ..... 9320138
Sep. 30, 1993 (GB) ..... 9320139

(51) Int. Cl.[7] ..... A24B 15/00
(52) U.S. Cl. ..... 131/331; 131/337
(58) Field of Search ..... 131/331, 337

(56) References Cited

U.S. PATENT DOCUMENTS 2,755,206 A * 7/1956 Statia ..... 131/337
2,863,461 A * 12/1958 Frost, Jr. ..... 131/337
3,428,045 A * 2/1969 Leake ..... 131/337
3,513,859 A * 5/1970 Carty ..... 131/337
3,538,924 A * 11/1970 Pruysers ..... 131/337
3,596,665 A * 8/1971 Lindgard ..... 131/337
3,991,773 A * 11/1976 Walker ..... 131/337
4,391,284 A * 7/1983 Sprecker et al. ..... 131/276
4,436,101 A * 3/1984 Seatts ..... 131/337
4,865,056 A * 9/1989 Tamaoki et al. ..... 131/337
5,174,309 A * 12/1992 Park ..... 131/337
5,331,981 A * 7/1994 Tamaoki et al. ..... 131/337

* cited by examiner

*Primary Examiner*—Aaron J. Lewis
(74) *Attorney, Agent, or Firm*—Pitney, Hardin, Kipp & Szuch, LLP

(57) ABSTRACT

This invention relates to the provision in a cigarette filter element of a capsule containing a deodorizer. The capsule is resistant to the handling endured before and during smoking, yet ruptures to release or expose the deodorizer upon extinguishing of the smoked cigarette. The deodorizer may comprise neutralizing or masking agents, or mixtures of both.

20 Claims, 2 Drawing Sheets

TOBACCO SMOKE FILTER ELEMENTS

BACKGROUND OF THE INVENTION

This invention relates to tobacco-smoke filter elements of smoking articles.

BRIEF DESCRIPTION OF RELATED ART

It is well known that after smoking articles have been smoked, the odor therefrom, in the absence of fresh air, remains in a room or ashtray for a considerable time. In enclosed spaces such as these the after-effects of smoking leave a lingering stale odor which can be found to be unpleasant by smokers and non-smokers.

This invention has as an object to overcome the odorous after-effects of smoking, particularly in enclosed spaces.

Various means of encapsulating liquid substances for release in tobacco-smoke filter elements have been proposed. For example, the Applicant has previously described in U.K. Patent Specification No. 1 234 802 the packaging of liquid substances in a hollow, preferably flexible, tube. The tube is filled with the substance in liquid form, then subjected to cooling to freeze the liquid substance, cut to lengths and then end-sealed by dipping into a solidifiable sealing medium or by application of end caps, for example.

U.K. 1 257 290 describes the use of such filled flexible tubes in a three-component filter element, a central section comprising the sealed capsule between two end sections. The filled flexible tubes are subjected to digital pressure before smoking occurs, whereby the friable end-sealant ruptures to release the encapsulated liquid and the released liquid may enhance the filtration efficiency of the filter element or otherwise affect the smoke flavour characteristics of the smoking article during smoking.

U.K. 1 267 272 discloses a method of producing wax coated capsules containing a liquid material such as water, which might also be useful in filter elements where increased filtration efficiency or flavour enhancement during smoking is desired.

However, all of these prior art patents are concerned with providing encapsulation methods which release the encapsulated material before smoking occurs. The capsules are designed to rupture under the digital pressures encountered before smoking.

SUMMARY OF THE INVENTION

This invention seeks to utilize an encapsulation technique which results in a filter element comprising a capsule which is resistant to compression from either digital or buccal pressure, yet which is fragile enough to break under pressure applied to the filter element after smoking ceases during the manual extinguishing process or 'stubbing out' thereof.

BRIEF DESCRIPTION OF THE DRAWINGS

In order that the invention may be easily understood and readily carried into effect, reference will now be made to the diagrammatic drawings hereof, in which.

DETAILED DESCRIPTION OF THE PREFERRED EMBODIMENTS OF THE INVENTION

Figure 1:
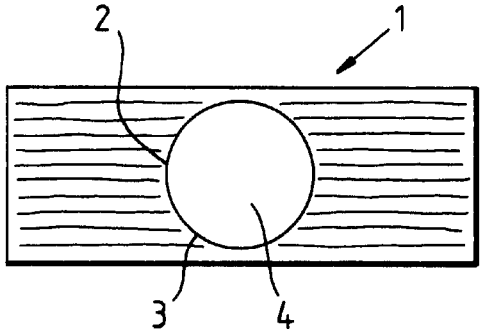
FIG. 1 shows in longitudinal section a capsule enclosed in a filter element in accordance with the invention.

The present invention provides a smoking article filter element comprised of filtration material and a capsule containing a deodoriser capable of reducing the smoke odour of the filter element after smoking of a smoking article incorporating said filter element has occurred, the capsule being resistant to the manual handling encountered during removal of said article from a packet and ignition of said article and being susceptible to breakage to expose said deodoriser within said filter element upon the extinguishing of the smoked said article.

Preferably a reduction of at least 50% is achieved in A perceived stale smoke odour, as measured on a ten-point sensory scale, where 10 is the score given to an untreated cigarette butt. Even more preferably, a reduction of at least 75% is achieved in perceived stale smoke odour.

Advantageously, the capsule extends lengthwise of the filter element and is preferably resistant to digital compression in a direction perpendicular to the longitudinal axis thereof and resistant to buccal pressure applied during smoking. As used herein the term 'buccal pressure' means pressure applied by the lips and/or teeth of a smoker. Preferably the capsule is also resistant to pressure applied in a direction along the longitudinal axis thereof before smoking occurs.

Advantageously, when the capsule is subjected to bending, or pressure applied at an angle acute to the longitudinal axis thereof, after smoking has occurred, the capsule fractures to release the deodoriser.

The capsule may suitably be comprised of a rigid material which exhibits brittleness on stress. For example, the capsule may comprise a length of thin-walled glass tubing, the ends of which may be sealed by heating or with a material capable of withstanding manual handling prior to and during smoking, yet which can be fractured after smoking. Other suitable materials include thin-walled aluminum tubing or hollow foodstuff material, such as, for example, pasta, or extruded hollow tubing of reconstituted tobacco material. The inner walls of the capsule material may advantageously be coated with a varnish or waterproof material, such as silicone, to preserve the rigidity of the capsule material by preventing absorption of the deodoriser over a prolonged period.

The capsule may alternatively be comprised of a wax, resin, natural or synthetic gum, latex or plastic material which retains its shape and strength at room temperature and at smoking temperature but which fractures to release the liquid deodoriser upon pressure applied to extinguish the smoking article. The capsule preferably comprises a material having a melting point above the temperature of the hot smoke within the filter. Examples of suitable waxes include beeswax, candelilla, carnauba, Shellac wax, caranday, sugarcane wax, myrtle wax and petroleum wax.

Suitable resins include epoxy resins, terpene resins, petroleum resins, ester gum, phenolic resins and rosin based resins.

Preferred gums are gums which will provide a barrier which prevents leakage of the deodoriser, such as gum arabic, locust bean, guar, alginates, carrageenan and pectin, where the deodoriser is in aqueous solution. If the deodoriser is in a non-aqueous solution, other vegetable gums which are water soluble are of use. Gelatins, especially hardened gelatin or fast-drying water insoluble glues can also be utilized in the present invention as capsule material.

Preferably the substances comprising the capsule have no effect on the taste of the mainstream smoke as smoking occurs.

In an alternative embodiment, the capsule and deodoriser may be comprised of a coated thread of material, the coating being such as a Plaster of Paris-type material or another inorganic insoluble agent, a wax material, a natural or synthetic gum, a resin or a varnish, all being selectable from the list above. Confectionery varnishes such as Shellac are the preferred varnishes. The thread of material may be a reed, a length of absorbent material, such as balsa wood, tobacco stem, wool, cotton, flax, twine, cellulose acetate tow or material similar to pipe-cleaner materials. The thread of material is treated with the deodoriser before being coated to provide a capsule containing a deodoriser.

In a further alternative embodiment, the capsule may be comprised itself of a brittle material treated with deodoriser and be further coated with a brittle or frangible material. The brittle material may be, for example, alkali-treated reconstituted rolled tobacco sheet or rolled paper which has been treated with deodoriser and then coated with wax or one of the other suitable coatings described above.

The coating of the capsule, which may itself be a brittle material treated with deodoriser, is selected so that, when the capsule is stressed as extinguishing occurs, the coating substantially all breaks up and falls away from the encapsulated material to expose as much as possible of the active surface area thereof. Stressed paper, plastic or polyolefin film can suitably be used, which materials would break up once fractured because of their pre-stressed nature.

The strength of the capsule is usually dependent on the type of coating used and its natural physical characteristics. The most readily variable characteristic of the coating affecting the strength of the capsule is the thickness of the coating.

The capsule may alternatively be comprised of a flexible material which can sustain bending. A piercing device may be placed alongside the capsule so that upon bending of the capsule, the wall of the capsule is pierced by the piercing device.

Alternatively, the capsule, whether flexible or rigid, may comprise a line of weakness, such as a scored line, a brittle point or a weak section, whereby when the capsule is stressed or twisted the capsule breaks at that line of weakness.

The capsule may advantageously be comprised of one or more layers or partitions. When the capsule fractures, the contents between the layer or partition can mix, and advantageously produce a reaction gas product which results in an enhanced dispersion of the deodoriser from the capsule. The reaction gas product may also assist in extinguishing the smoking article. Preferably the enhanced dispersion of the deodoriser is brought about by an acid/base reaction. Advantageously, the acid is an organic acid, such as one or more of lactic, citric, acetic, tartaric, maleic or fumaric acids. The basic material is advantageously sodium bicarbonate or the like. One or more of the acid or base, or even the deodoriser, may be in solid form, provided that upon rupture of the capsule they come into contact with an aqueous solution which generates the reaction. Advantageously the reaction gas product is carbon dioxide.

The capsule may be located within the filtration material of the filter element or it may be located in the cavity of a multiple filter element, between two end sections of filtration material, for example.

When the deodoriser is fluid, it is advantageously in solution. The solution may be an aqueous solution or a solution of deodoriser in a low molecular weight organic material, such as an alcohol, aldehyde, ketone or ester. Alternatively, the deodoriser may be held in an emulsion or as a colloid. The above applies also to film deodorisers described below.

Deodorisers suitable for use in the present invention may be neutralising agents, masking agents or mixtures of both. A neutralising agent, in the context of this invention, is a substance which gives a subjective reduction in stale tobacco smoke odour relative to that experienced from cigarette butts that have been untreated, which latter cigarette butts score 10 on the above-mentioned ten-point sensory scale. The reduction in odour will be progressively more effective over a period of time as the neutralization process takes effect. Over a long period of time the stale tobacco smoke odour will not return. In other words, removal of smoke odour occurs. A neutralising agent may possess an odour but this odour is incidental to the effect which the neutralising agent has in reducing stale smoke odour.

Neutralising agents can be passive or active in nature. Active neutralising agents generally exude their neutralising effect and tend to be fluids which volatilise in atmosphere. Passive neutralising agents are generally solid in nature and are inactive in that they draw the odour into them without necessarily exuding any counter-acting flavour or odour.

Masking agents, in the context of this invention, can be characterised as physical or chemical masking agents. A chemical masking agent is a substance which provides sufficient odour of its own to hide or disguise stale tobacco smoke odour. Over a period of time, when the masking agent has dissipated, the odour of stale smoke will return. A masking agent is most effective at the time of application. A physical masking agent comprises a substance which, when in contact with the surrounding filter material, acts to encapture the odour making substances within a film or coagulation of material. These agents are known below as film deodorisers.

A film deodoriser, in the context of this invention, is a substance which gives a subjective reduction in stale smoke odour relative to that experienced from cigarette butts that have been untreated, which latter cigarette butts score 10 on the above-mentioned ten-point sensory scale. The reduction in odour is achieved by forming a film over the filtration material of the filter element, thereby capturing the particulate material trapped by the filter element during smoking. As the particulate matter contains compounds which produce a stale smoke odour, forming a film over the condensate-containing filtration material effectively prevents the odour materials from evaporating from the filter element, thereby preventing stale odour. Preferred film deodorisers include polyvinyl acetate glue., cellulose ethers, such as methyl or ethyl cellulose ether, for example, alginates, such as propylene glycol alginate, for example, and cellulosic materials, such as sodium carboxymethyl cellulose or hydroxypropyl cellulose, for example.

A preferred fluid deodoriser for use in the present invention comprises 2-trans-3,7-Dimethyl-2,6-octadien-8-ol, often known as Geraniol. Other suitable fluid deodorisers include 1-Carvone, 1-Carveol, terpinyl acetate, Geranyl propionate, citronellyl butyrate, citral, cis-3-Hexenol, triacetin, benzyl benzoate, acetone, safrole, terpinyl propionate, methyl salicylate, hexyl cinnamic aldehyde, isopropyl alcohol, triethylglycol diacetate (TEGDA), Odor-Gone (Trade Name), methyl cinnamaldehyde, linalyl propionate, acetic acid, citronellal, citronellyl formate, geranyl formate and linalool. Mixtures of these compounds are also suitable. Many other masking agents, such as perfumes, e.g. essential oils used in pot pourri, are also suitable compounds for use in the present invention.

Both a neutralising agent and a masking agent may be used together to form the deodoriser. Sensory evaluation of tested cigarette butts show that single deodorisers may Of exhibit neutralising, masking and film properties over time.

The fluid deodoriser, when released, evaporates and neutralises the smoke odour, both within the filter element and beyond the confines of the filter element.

The fluid deodoriser may also comprise a carrier such as TEGDA or glycerol triacetate. Depending on the compositions of the filtration material of the filter element these carriers may also have an effect on the removal of the stale smoke odour. In other words, the carrier may dissolve the filtration material, capturing the particulate material trapped by the filter element or the carrier may also have its own odour which may be an effective deodoriser. As the particulate matter contains compounds which produce a stale smoke odour, dissolving the condensate-containing filtration material effectively prevents the odour materials from evaporating from the filter thereby preventing stale odour.

When the deodoriser is a passive neutralising agent the deodoriser preferably comprises an absorbent material, which may advantageously be granular. Activated carbon has been found to be particularly effective at reducing the stale smoke odour of individual cigarette butts, especially in an enclosed space such as an ashtray.

Other suitable passive deodoriser absorbent materials include styrene divinylbenzene material, polymers based on 2,6-diphenyl-p-phenylene oxide, activated charcoal, molecular sieve zeolites, silanized glass wool, alumina, silica gel, silica gel bonded by amino-, diol-, cyano-, octyl-, octadecyl- groups, diatomite firebrick based dust, polytetrafluoroethylene (PTFE) based resins, polyaromatic cross-linked resins, high surface area chalk, amberlite resins, magnesium silicate or natural biopolymers. All of these may be untreated, or treated with materials known as stationary phases.

The passive deodoriser may be in pellet form and may comprise a weak binder material to adhere the particles of deodoriser together. Preferably the adhered pellet is of a friable nature if stressed, so that the pellet disintegrates to expose a reasonable active surface area of the deodoriser.

Alternatively the passive deodoriser may be extruded with a binder, preferably as a thin rod. The rod of deodoriser and binder material may be co-extruded with a coating to provide a capsule enclosing a coated deodoriser.

The passive deodoriser may also be present as granules adhered to a thread, the thread having deodoriser granules adhered thereto being dipped in a coating substance to enclose the deodoriser in a capsule.

The film deodoriser may also be a solvent of the filtration material comprising the filter element. If the filter element comprises more than one type of filtration material, solvents for both types of filtration material may be found in the film deodoriser. Preferred solvents for cellulose acetate filtration material include triethylglycol diacetate, glycerol triacetate and 2 ethoxyethyl acetate. Other suitable compounds would be known to those skilled in the art.

The film deodoriser may advantageously be a material which is solid at room temperature but which becomes liquid at the more elevated temperatures experienced in a filter element during smoking thereby flowing easily from the ruptured capsule. The film deodoriser may thus exhibit a phase-change property. Materials exhibiting this property include, for example, $C_{17}$ or $C_{18}$ hydrocarbons.

An alternative phase-change property exhibited by the film deodoriser may be that of thixotropy, whereby the film deodoriser is substantially solid or very viscous at room temperature and under the normal conditions of manual handling but becomes fluid when subjected to stress, such as the stress experienced during extinguishing of a cigarette during stubbing out and fracturing of the capsule holding the film deodoriser.

Film deodorisers suitable for use in the present invention may also include or incorporate neutralising agents, masking agents or mixtures of both.

FIG. 1 of the drawings shows (not to scale) a smoking article filter element 1 comprised of cellulose acetate fibers, for example. Located within the fibers of the filter element 1 is a capsule 2. The capsule 2 is comprised of a wax wall 3 of beeswax which surrounds an aqueous solution of deodoriser 4. Our experiments have shown that 10 microlitres ($\mu$l) or less of a deodoriser when injected along the length of a 20mm cellulose acetate filter element attached to a smoking material rod length is sufficient to neutralise the stale odour from the cigarette butt which is extinguished by stubbing out after smoking of the cigarette has ceased.

The capsule 2 was formed by freezing a solution of water and deodoriser to about −20° C. until small crystals are formed. A frozen crystal or crystals of water and deodoriser is dropped into molten wax and removed by spatula after a wax coat has formed around the cold crystal(s). The frozen ice gradually becomes liquid as the coated capsule reaches room temperature. The method of GB 1 267 272 can also be used to produce such coated aqueous solutions.

The wax coated solution of water and deodoriser as a round capsule may be dropped from a feed reservoir into the filter tow as it is gathered prior to passing through the garniture. Alternatively, the capsule may be held in the centre section of a tri-partite multiple filter element.

The wax coating material is selected so that it has a melting point above the temperature (about 60° C.) reached in a filter element during smoking and which has an acceptable strength able to resist the manual and buccal handling pressures applied to a cigarette before and during smoking. This can be achieved, for example, by varying the thickness or type of the wax coating until the desired strength properties are achieved.

Figure 1A:
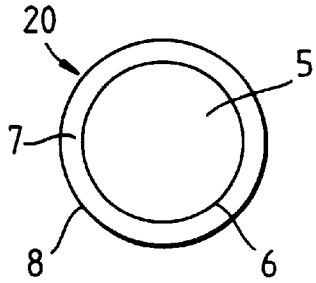
FIG. 1*a* shows a cross-section of a layered capsule suitable for use as shown in FIG. 1.

FIG. 1*a* shows a capsule 20 which can be used in the FIG. 1 embodiment. The capsule 20 is layered. The inner cavity 5 of the capsule 20 contains deodoriser in aqueous solution and produced as described above. Once the wax coating 6 has solidified, the coated capsule is dipped again into molten wax, quickly removed and rolled or dipped in an acid/base solids mixture 7 of, for example, sodium bicarbonate and tartaric acid, and then re-dipped into the molten wax, removed and allowed to solidify. An outer wax wall 8 is thus provided. When the capsule 20 is crushed during the stubbing out of the cigarette by digital pressure, there is a reaction between the acid and base on contact with water to produce carbon dioxide, which helps to disperse the deodoriser as the capsule is broken.

In this embodiment the acid and base were both in dry, solid form. In an alternative, one of the acid or base may be in solution in one cavity and the other may be either in solid form or in solution with the deodoriser in another cavity. The capsule may have two or more layers. Each of the layers may comprise one or more of the acid, base or deodoriser substances.

Figure 2:
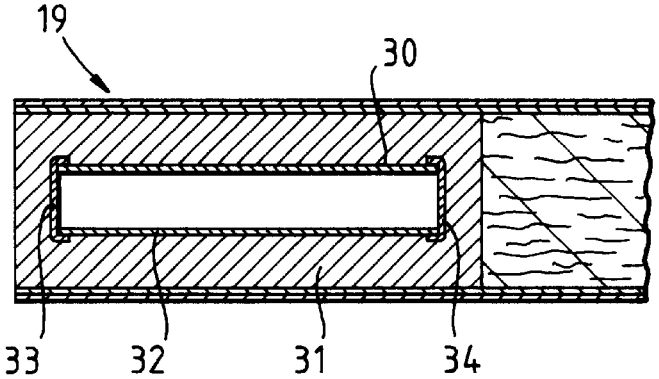

FIG. 2 shows a filter element 19 according to the invention which comprises a capsule 30 enclosed in cellulose acetate filter material 31. The capsule 30 is a thin tube 32 of glass. The ends 33 of the glass tube are sealed by wax 34. The tube 32 contains deodoriser in aqueous solution.

The tube 32 in filled condition is produced by dipping the tube in an aqueous solution of deodoriser to introduce the deodoriser into the tube. The filled tube is then removed and cooled to below the freezing point of the aqueous solution of deodoriser. The frozen tube is then end-dipped into warm wax and the wax 34 cools to form end caps. The end sealant of wax 34 is selected to withstand the temperature achieved in the filter during smoking and also to have the necessary strength to withstand manual handling or buccal pressure prior to and during smoking.

The tube 32 or the wax 34 may one or both fracture on extinguishing of the cigarette by stubbing out after smoking, thereby releasing the deodoriser.

In an embodiment not shown, the tube may be subdivided, for example axially, to form two inner cavities. In one cavity the deodoriser in aqueous solution can be held and in the other cavity an acid/base mixture in solid form can be held. On fracture of the tube, the substances would contact one another and produce a reaction product which enhances the dispersion of the deodorisers. In this instance also, one of the acid or base of the acid/base mixture may be in solid form in one cavity or in solution with the deodoriser in another cavity. A modification of this idea is the provision of two separate tubes each containing one of the reaction products. The deodoriser could be held in one or both of the tubes.

Figure 3:
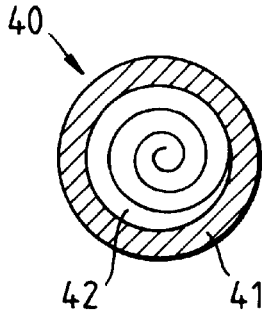
FIG. 3 shows, in cross-section, a capsule having a rolled center and being enclosed in a filter element in accordance with the invention.

The embodiment of FIG. 3 shows in cross-section a filter element 40 of cellulose acetate fibers 41 surrounding a tube 42. The tube 42 is comprised of sheet reconstituted tobacco in rolled form which has been treated by boiling the rolled sheet for 5 to 10 minutes in a concentrated solution of sodium hydroxide. It has been found, for example, that injecting a rod of tobacco material with ½ ml of 6M sodium hydroxide and heating for 10 minutes at 100° C. renders the tobacco material brittle. Once removed from the sodium hydroxide and washed, the rolled sheet is either filled with or dipped in an aqueous solution of deodoriser. The deodoriser treated sheet is then dipped in molten wax and the wax allowed to solidify. When the rolled rod is fractured, the wax falls away from the sheet surface and the deodoriser evaporates and is released to atmosphere.

Figure 4:
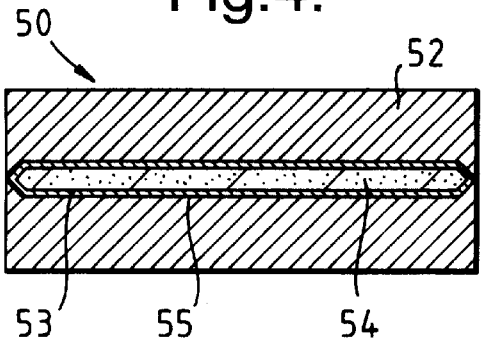
FIG. 4 shows in longitudinal cross-section a further filter element comprising a capsule and being in accordance with the invention.

The embodiment depicted in FIG. 4 comprises a filter element 50 of cellulose acetate fibers 52 enclosing a capsule 53. The capsule comprises a thread 54 of reconstituted tobacco material. The thread 54 is produced by extruding a thread of reconstituted tobacco material and passing the thread in a flexible condition through a bath comprising an aqueous solution of deodoriser. The flexible thread is then passed through a further bath of sealant material 55. In this embodiment the sealant material is a Plaster of Paris-type material which is nipped to seal the ends of the capsule whilst the Plaster of Paris-type coating is still flexible. The Plaster of Paris-type material hardens to form a protective coating to the deodoriser-treated thread. Upon the action of extinguishing the smoking article by stubbing out, the Plaster of Paris wall of the thread will break and release the deodoriser.

Figure 5:
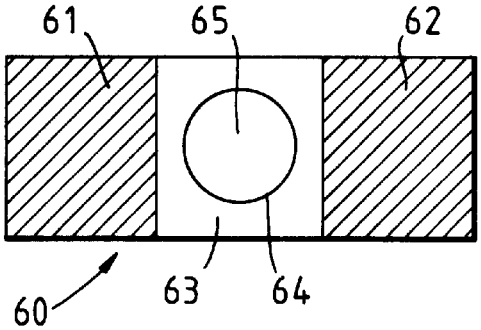
FIG. 5 shows a capsule in a multiple filter element in accordance with the present invention.

FIG. 5 of the drawings hereof shows a multiple filter element 60 comprising a first filtration section 61 and a second filtration section 62. Suitable filtration material for filtration sections 61,62 includes fibrous cellulose acetate or polypropylene material, for example. A cavity 63 has located therewithin a capsule 64 which comprises a wall of a material which is compressible on stubbing out of a smoked filter tip cigarette to release the deodoriser 65 held within the capsule 64. The deodoriser may be any of the materials listed above. The cavity 61 may have an annular support member to protect the capsule 64.

Figure 6:
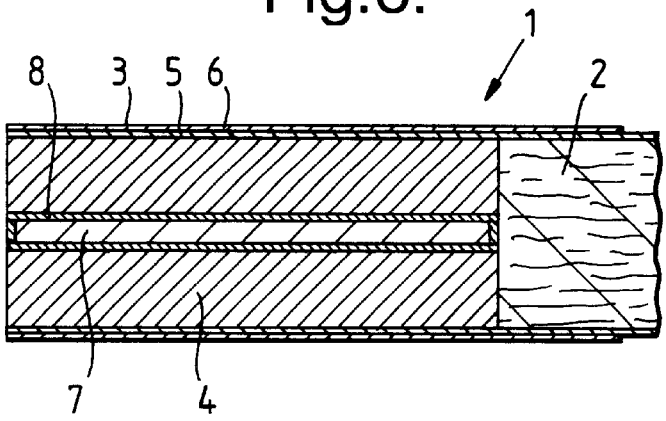
FIG. 6 shows a filter element according to the invention.

In FIG. 6 there is shown the filter tip end of a filter tipped cigarette 1 comprising a rod 2 of tobacco material and a filter element 3. The filter element 3 is comprised of filtration material 4, such as fibrous cellulose acetate wrapped in a paper wrapper 5 and attached to the rod 2 by tipping paper 6. Extending lengthwise of the filter element 3 is a thin rod 7 of activated carbon material. The thin rod 7 is encased by a wax coating 8 of beeswax, for example, to form a coated capsule. The wax coating prevents the carbon from being exposed to the mainstream smoke and has a melting point above 60° C., the kind of temperature encountered in a filter element in the last puff of a filter-tipped cigarette. The wax-coated thin rod 7 is resistant to pressure perpendicular to its length during normal manual handling, but fractures when the action of stubbing out occurs on extinguishing the cigarette 1. As the thin rod 7 fractures, the wax coating 8 also fractures and begins to break away from the thin rod 7 of activated carbon material. A region of the surface area of the activated carbon material becomes exposed within the filter element 3. The stale odour of the particulate material held within the filtration material 4 is absorbed by the activated carbon material, thus reducing the stale smell of the butt overall.

With this invention, each smoked cigarette butt, when stubbed out in the usual manner, loses its ability to produce a high level of stale smoke odour when left in an enclosed unventilated space.

Figure 7:
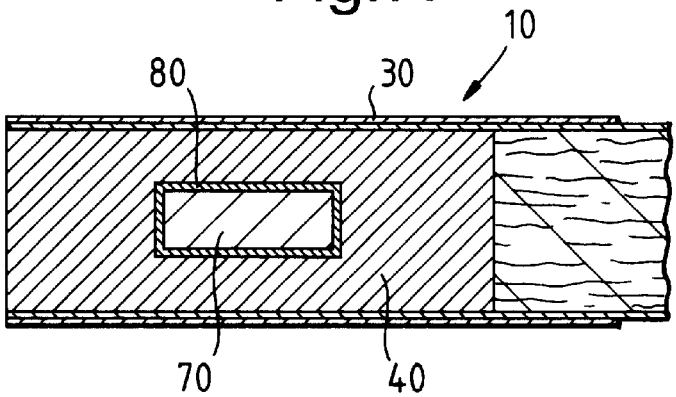
FIG. 7 shows a filter element according to another embodiment of the invention.

The embodiment shown in FIG. 7 follows the same principle of that shown in FIG. 6. Not all the same parts are re-numbered. In FIG. 7 the filter tipped cigarette 10 comprises a filter element 30 of fibrous cellulose acetate filtration material 40 within which is pellet 70 of friable activated carbon granules. The pellet 70 is produced by pelleting the carbon granules with a weak binder. The pellet 70 is then coated with a wax material 80. The pellet 70 may be dropped into the tow as the tow is gathered before passing into the garniture of a filter making machine to form a continuous filter rod and thus the pellet 70 is not subjected to excessive handling. Within the filter element 30 the pellet 70 is protected by the filtration material 40.

Upon extinguishing of the cigarette 1 by a stubbing out action, the pellet 70 fractures, because of the friable nature of the weakly bound activated carbon material the pellet breaks up, thus exposing a large surface area of activated carbon granules. The wax coating also breaks away from the surface of the pellet 70. The exposed activated carbon granules readily absorb the stale odour produced by the particulate matter held within the filtration material 40 of the filter element 30.

The particular embodiments of the invention described in FIG. 6 and 7 have been found to be particularly effective for deodorising a used cigarette butt. Thus, the present invention is able to leave, for example, ashtrays, the main repository of butts, with a much curtailed or zero stale smoke odour.

Figure 8:
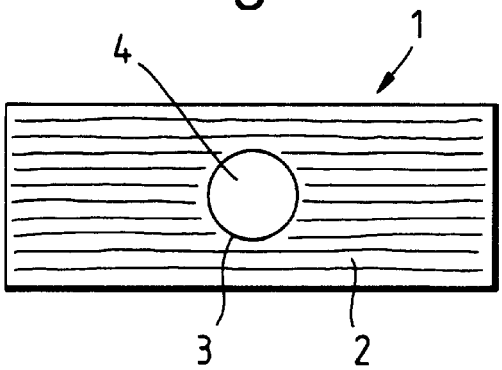
FIG. 8 shows in longitudinal section a capsule enclosed in a filter element in accordance with the invention.
Figure 9:
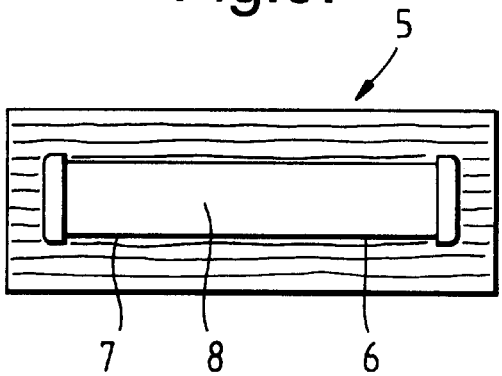
FIG. 9 shows in longitudinal section a capsule in the form of a tube enclosed in a filter element in accordance with the invention attached to a smoking material rod.

The embodiment depicted in FIG. 8 is a filter element 1 in accordance with the invention and comprising filtration material 2 and a capsule 3 containing a film deodoriser. The filtration material 2 comprises fibrous cellulose acetate, for example. The capsule 3 is comprised of a wall made of wax around a film deodoriser 4. The wax may be beeswax or petroleum wax, for example, and thus resistant to the temperatures of up to 60° C encountered in a filter element at the last puff of a filter-tipped cigarette. The film deodoriser comprises a deoderiser known as triethylglycol diacetate, known as TEGDA, and being a solvent for cellulose acetate. The film deodoriser may also include an amount of the substance known as Geraniol, a further, deoderiser but which operates other than by dissolving the filtration material.

The film deodoriser may incorporate further neutralising or masking agents to obtain maximum effect or an effect subjectively preferred by a panel of smokers.

The film deodoriser may comprise alternative substances which exhibit phase change either due to increased temperature or increased stress. These substances can be held in either of the embodiments depicted in FIGS. 1 or 2. FIG. 2 shows filter element 5 incorporating a capsule 6 comprised of a thin-walled plastic tube 7 with sealed ends. The capsule releases the film deodoriser 8 upon fracture during the stubbing out of a smoked filter-tipped cigarette.

In an embodiment not shown, the capsule containing the film deodoriser may be located in the cavity between two end sections of a multiple filter element. Upon rupture of the capsule, the fluid deodoriser flows towards and forms a film around the filtration material containing odorous condensate, thereby reducing the stale smoke odour associated with smoked cigarette butts.

In order to evaluate the effectiveness of some deodorisers, the compounds described in the following Tables were each injected in 10 $\mu$l volumes into a smoked butt of an identical filter cigarette. The injected butts were then enclosed in sealed containers and submitted to a sensory panel for a 'sniff-test' immediately after enclosing in the sealed container and then again after 24 hours of enclosure. Three particular features were subjectively scored on a scale of 1–10.

The first was the smoke level, i.e. the amount of stale cigarette butt smell, 10 being the highest and the smell associated with the control cigarette; second was the non-tobacco odour level, i.e. the amount of smell other than stale cigarette butt smell, 10 being the strongest non-tobacco odour; and third was the subjective acceptability of the resulting odour, 10 being a very acceptable smell. Thus some odours may be scored in the latter two categories as highly non-tobacco smelling but also being an unacceptable smell (e.g. 10,0), whilst other odours may be scored as highly non-tobacco smelling but with a very acceptable smell (e.g. 10,10).

The following compounds were shown to be ineffective deodorisers immediately after enclosure in the sealed containers—glycerol, water, triacetin, acetone and sodium hydroxide. After 24 hours, the following were found to be ineffective against the control, smoked and untreated enclosed cigarette butt - glycerol, water, sodium hydroxide, octadecane, potassium bicarbonate and tartaric acid. Even these less effective deodorisers show how their effect varies with time, e.g. triacetin improves as a deodoriser with time.

The Tables also show that other compounds are better at masking the odour from a smoked cigarette butt either initially or over time, thus exhibiting both neutralising and masking affects with time. Tables 1 and 2 show deodorisers used alone tested after 0 hours and 24 hours. Tables 3 and 4 show some mixtures of deodorisers tested after 0 hours and 24 hours.

TABLE 1

Sensory Scores for Cigarette Butts (after 0 hours)

| Compound | Smoke level 10 = highest | Non Tobacco Odour level 10 = highest | Acceptability 10 = highest |
|---|---|---|---|
| Citral | 2 | 9 | 6 |
| Cis-3-Hexenol | 5 | 6.5 | 5 |
| Glycerol | 7 | 2 | 3 |
| Linalool | 2 | 8 | 6.5 |
| Geraniol | 3 | 7.5 | 6 |
| Terpinyl acetate | 3.5 | 5.5 | 6 |
| Water | 9 | 0 | 1 |
| Triacetin | 8 | 1.5 | 2 |
| Benzyl benzoate | 6.5 | 2 | 5 |
| Acetone | 7 | 4 | 1 |
| Geranyl propionate | 5.5 | 4 | 3 |
| Acetic Acid | 6 | 10 | 0 |
| Safrole | 5.5 | 6 | 3.5 |
| Sodium hydroxide | 9 | 0 | 0.5 |
| 1-Carveol | 4.5 | 7 | 5 |
| Terpinyl propionate | 4.5 | 5.5 | 4.5 |
| Methyl salicylate | 5 | 5.5 | 3.5 |
| Hexyl cinnamic aldehyde | 7 | 2 | 3 |
| Citronellyl butyrate | 5.5 | 2 | 4.5 |
| Octadecane | 6.5 | 2 | 3 |
| Isopropylalcohol | 6.5 | 3 | 3.5 |
| TEGDA | 5 | 1.5 | 4 |
| OdorGone | 5.5 | 3.5 | 4 |
| Potassium bicarbonate | 7.5 | 1.5 | 2.5 |
| Tartaric Acid | 6.5 | 1.5 | 4 |
| Citronellal | 3 | 9 | 3.5 |
| Methyl cinnamaldehyde | 4.5 | 5 | 4.5 |
| Linalyl propionate | 5 | 4 | 4.5 |
| Citronellyl formate | 3 | 7.5 | 4 |
| Geranyl formate | 4.5 | 7.5 | 3 |

TABLE 2

Sensory Scores for Cigarette Butts (after 24 hours)

| Compound | Smoke level 10 = highest | Non Tobacco Odour level 10 = highest | Acceptability 10 = highest |
|---|---|---|---|
| Citral | 3 | 8 | 5.5 |
| Cis-3-Hexenol | 4.5 | 7 | 3.5 |
| Glycerol | 7 | 2 | 2.5 |
| Linalool | 3.5 | 7.5 | 5.5 |
| Geraniol | 3 | 6 | 6 |
| Terpinyl acetate | 3.5 | 7 | 4.5 |
| Water | 7 | 1 | 1.5 |
| Triacetin | 5.5 | 2 | 4 |
| Benzyl benzoate | 4.5 | 3.5 | 5 |
| Acetone | 4.5 | 2 | 5 |
| Geranyl propionate | 2 | 6.5 | 5 |

TABLE 2-continued

Sensory Scores for Cigarette Butts (after 24 hours)

| Compound | Smoke level 10 = highest | Non Tobacco Odour level 10 = highest | Acceptability 10 = highest |
|---|---|---|---|
| Acetic Acid | 5.5 | 9.5 | 0.5 |
| Safrole | 4 | 6 | 3 |
| Sodium hydroxide | 7 | 1.5 | 2.5 |
| 1-Carveol | 2.5 | 7 | 6 |
| Terpinyl propionate | 3.5 | 6.5 | 5.5 |
| Methyl salicylate | 4 | 7 | 3.5 |
| Hexyl cinnamic aldehyde | 4 | 5 | 5 |
| Citronellyl butyrate | 4.5 | 3.5 | 5.5 |
| Octadecane | 7 | 2.5 | 3.5 |
| Isopropylalcohol | 5.5 | 2 | 4 |
| TEGDA | 5 | 1.5 | 4 |
| OdorGone | 3 | 3.5 | 6.5 |
| Potassium bicarbonate | 6.5 | 1.5 | 3 |
| Tartaric Acid | 6.5 | .2 | 2.5 |
| Citronellal | 3.5 | 8.5 | 5 |
| Methyl cinnamaldehyde | 4 | 7.5 | 3.5 |
| Linalyl propionate | 4 | 4 | 5 |
| Citronellyl formate | 4.5 | 6 | 4.5 |
| Geranyl formate | 4.5 | 7 | 3 |

TABLE 3

Sensory Scores for Cigarette Butts (after 0 hours)

| Compound | Smoke Level | Odour Level | Acceptability |
|---|---|---|---|
| Control | 10 | 0 | 0 |
| OdorGone | 7 | 5.5 | 4 |
| TEGDA + 1-Carvone | 5 | 5.5 | 5 |
| TEGDA + Geraniol | 5 | 3.5 | 5.5 |
| TEGDA + Terpinyl Acetate | 4 | 5 | 6 |
| TEGDA + 1-Carvone + Geraniol | 4 | 5 | 6 |
| TEGDA + Citral | 3.5 | 7 | 6 |
| TEGDA + Geranyl Propionate + Geraniol | 6.5 | 3.5 | 3 |
| Water + 1-Carvone | 5.5 | 5.5 | 5.5 |
| Carbon | 5 | 2 | 5 |
| Right Guard (RTM)* | 4 | 7 | 6.5 |

TABLE 4

Sensory Scores for Cigarette Butts (after 24 hours)

| Compound | Smoke Level | Odour Level | Acceptability |
|---|---|---|---|
| Control | 10 | 0 | 0 |
| OdorGone | 4 | 4 | 4.5 |
| TEGDA + 1-Carvone | 3.5 | 6.5 | 5.5 |
| TEGDA + Geraniol | 2.5 | 5.5 | 6.5 |
| TEGDA + Terpinyl Acetate | 3.5 | 6.5 | 5 |
| TEGDA + 1-Carvone + Geraniol | 3 | 6 | 6 |
| TEGDA + Citral | 2 | 8 | 6 |
| TEGDA + Geranyl Propionate + Geraniol | 3 | 6 | 5 |
| Water + 1-Carvone | 5.5 | 4 | 4 |
| Carbon | 3.5 | 4 | 5.5 |
| Right Guard (RTM)* | 2.5 | 5.5 | 7 |

*A deodorant spray

What is claimed is:

1. A smoking filter element comprising a filtration material and a capsule including a deodoriser wherein said capsule incorporates one or more layers, said capsule susceptible to breakage to expose said deodoriser within said filter element wherein the contents of each layer mix and produce a reaction gas product.

2. A smoking article filter element according to claim 1, wherein said capsule is comprised of a rigid material which exhibits brittleness on stress.

3. A smoking article filter element according to claim wherein said capsule is comprised of glass tubing, think-walled aluminum tubing, hollow foodstuff material, Plaster of Paris, an inorganic insoluble agent, or extruded hollow tubing of reconstituted tobacco material.

4. A smoking article filter element according to claim 1, wherein the inner walls of the capsule material are coated with a varnish or waterproof material.

5. A smoking article filter element according to claim 1, wherein said capsule is comprised of a wax, resin, natural or synthetic gum, latex or plastic material.

6. A smoking article filter element according to claim wherein said capsule comprises a material having a melting point above the temperature of hot smoke within the filter element.

7. A smoking article filter element according to claim 1, wherein said capsule comprises at least one selected from the group consisting of beeswax, candelilla, carnauba, Shellac wax, caranday, sugarcane wax, myrtle wax, petroleum wax epoxy resins, terpene resins, petroleum resins, ester gum, phenolic resins, resin based resins gum arabic, locust bean, guar, alginates, carrageenan, pectin and vegetable gums.

8. A smoking article filter element according to claim 1, wherein said capsule comprises a thread of material treated with deodoriser and coated with coating.

9. A smoking article filter element according to claim 1, wherein said capsule is a flexible material which can sustain bending but which has a wall which is piercable by a piercing device located alongside the capsule.

10. A smoking article filter element according to claim 1, wherein the deodoriser is a fluid in one selected from the group consisting of an aqueous solution and a solution in a low molecular weight organic material.

11. A smoking article filter element according to claim 1, wherein the deodoriser is selected from the group consisting of a neutralising agent, a masking agent and mixtures thereof.

12. A smoking article filter element according to claim 1, wherein the deodoriser is selected from the group consisting of 2-trans-3, 7-Dimethyl-2-, 6-octadien-8-ol (Geraniol); 1-Carvone, 1-Carveol, terpinyl acetate, Geranyl propionate, citronellyl butyrate, citral, cis-3-Hexenol, triacetin, benzyl benzoate, acetone, safrole, terpinyl propionate, methyl salicylate, hexyl cinnamic aldehyde, isopropyl alcohol, triethylglycol diacetate (TEGDA), OdorGone , methyl cinnamaldehyde, linalyl propionate, acetic acid, citronellal, citronellal formate, geranyl formate, linalool and mixtures thereof.

13. A smoking article filter element according to claim 1, wherein the deodoriser is selected from the group consisting of acetic acid, citronellal, citronellal formate, geranyl fornate, linalool, perfumes and mixtures thereof.

14. A smoking article filter element according to claim 1, wherein the deodoriser is an absorbent granular material.

15. A smoking article filter element according to claim 14, wherein the deodoriser is selected from the group consisting of activated carbon, styrene divinyl benzene, polymers based on 2,6-diphenyl-p-phenylene oxide, activated charcoal, molecular sieve zeolites, silanized glass wool, alumina, silica gel, silica gel bonded by amino-, diol-, cyano-, octyl-, octadecyl-groups, diatomite firebrick based dust, polytetrafluoroethylene (PTFE) based resins, polyaromatic cross-linked resins, high surface area chalk, amberlite resins, magnesium silicate and natural biopolymers.

16. A smoking article filter element according to claim 14, wherein the deodoriser, when granular, is either in pelletised form, an extruded rod or a thread having granules of deodoriser adhered thereto.

17. A smoking article filter element according to claim 1, wherein the deodoriser is selected from the group consisting of polyvinyl acetate glue, methyl cellulose ether, ethyl cellulose ether, propylene glycol alginate, sodium carboxymethyl cellulose, hydroxypropylcellulose, triethylglycol diacetate, glycerol triacetate and 2-ethyoxyethyl acetate, and mixtures thereof.

18. A smoking article filter element according to claim 1, wherein said capsule extends lengthwise of said filter element and is resistant to digital compression in a direction perpendicular to the longitudinal axis thereof and to buccal pressure applied during smoking.

19. A method of deodorizing smoking article filter elements compnsing:

providing a filter element including a capsule comprising a deodorizer, the capsule incorporating one or more layers, and exposing the, deodorizer within the filter after smoking by applying a stubbing out action wherein the contents of each layer mix and produce a reaction gas product.

20. A method of deodorizing smoking article filter elements according to claim 19, wherein the capsule is resistant to manual handling encountered during removal of the article from a packet, resistant to digital compression perpendicular to longitudinal axis thereof and resistant to buccal pressure applied during smoking.

* * * * *